US006561921B2

(12) United States Patent
Takeda

(10) Patent No.: US 6,561,921 B2
(45) Date of Patent: May 13, 2003

(54) IRON GOLF CLUB

(75) Inventor: Hitoshi Takeda, Tsubame (JP)

(73) Assignee: K. K. Endo Seisakusho (JP)

( * ) Notice: Subject to any disclaimer, the term of this patent is extended or adjusted under 35 U.S.C. 154(b) by 0 days.

(21) Appl. No.: 09/949,373

(22) Filed: Sep. 7, 2001

(65) Prior Publication Data

US 2002/0034984 A1 Mar. 21, 2002

(30) Foreign Application Priority Data

Sep. 21, 2000 (JP) ..... 2000-287246
Jul. 30, 2001 (JP) ..... 2001-230285

(51) Int. Cl.[7] ..... A63B 53/02
(52) U.S. Cl. ..... 473/305; 473/349; 473/324
(58) Field of Search ..... 473/305–315, 473/245–248, 324, 349

(56) References Cited

U.S. PATENT DOCUMENTS 3,825,991 A * 7/1974 Cornell ..... 29/412
5,885,170 A * 3/1999 Takeda ..... 473/306
5,984,803 A * 11/1999 Chappell ..... 473/287
6,102,274 A * 8/2000 Nagamoto ..... 228/114.5
6,293,876 B1 * 9/2001 Hahn De Bykhovetz et al. 473/287

* cited by examiner

*Primary Examiner*—Stephen Blau
(74) *Attorney, Agent, or Firm*—Akerman Senterfitt

(57) ABSTRACT

An iron golf club with a head whose center of gravity is easy to adjust, preventing the center of gravity from being biased toward a hosel or a heel. A head body 8 includes a face 3 in a front, a heel 6 at a lower portion of a first side of the face 3 and a hosel 7 above the heel 6. A shaft 2 is connected to the hosel 7 that is formed with a hollow portion 9. By forming the hollow portion 9 that way, it becomes easier to adjust the center of gravity of the head 1, preventing the center of gravity from being biased toward the hosel 7 and the heel 6. To prevent the increase of weight of the hosel 7 eventually leads to preventing the center of gravity of the head 1 from getting too high.

8 Claims, 5 Drawing Sheets

IRON GOLF CLUB

BACKGROUND OF THE INVENTION a) Field of the Invention

The present invention relates to a golf club.

b) Prior Art

Golf clubs which comprise a head and a shaft, are generally classified as one of three types: a wood, an iron, or a putter. Irons are classified by the loft angle of their head. Irons with a small loft angle (for example, from 20 to 30 degrees) are called "long irons", while irons with a large loft angle (for example, from 40 to 50 degrees) are called "short irons". Normally, irons are numbered in ascending order from longest to shortest, for example, Nos. 1, 2, 3, 4, 5, 6, 7, 8, 9, PW (pitching wedge) and SW (sand wedge).

The head of an iron club includes a face which is the front of the head for hitting golf balls and a hosel on one side of the face for connecting a shaft thereto.

In an iron golf club, the axial length from an upper end of a shaft through the center of the shaft to a sole of the head body is about 40.5 to 39.5 inches (1029–1003 mm) for 1st iron, about 40 to 39 inches (1016–991 mm) for 2nd iron, about 39.5 to 38.5 inches (1003–978 mm) for 3rd iron, about 39 to 38 inches (991–965 mm) for 4th iron, about 38.5 to 37.5 inches (978–953 mm) for 5th iron, about 38 to 37 inches (965–940 mm) for 6th iron, about 37.5 to 36.5 inches (953–927 mm) for 7th iron, about 37 to 36 inches (940–914 mm) for 8th iron, about 36.5 to 35.5 inches (927–902 mm) for 9th iron, about 36 to 35 inches (914–889 mm) for PW, about 36 to 35 inches (914–889 mm) for SW, respectively.

In the meantime, an iron golf club head includes a head body having a rear face formed with a concave portion which is called "cavity", deeply gouged out to be formed into an undercut shape, thus removing a surplus amount of its thickness, so that the position of the center of gravity is adjusted by redistributing the surplus thickness thus removed to other portions. However, there is a drawback in such conventional iron golf club that the weight is liable to incline too heavily toward a hosel or a heel positioned at the base of the hosel, as the hosel and the heel are solid. Accordingly, there is a problem that the center of gravity of a head is normally located too much to the heel or hosel side, rather than in the center of the face.

Further, for a golf player who is powerless, the lower the center of gravity of a club head is, the more easily balls are hit upwardly.

For that reason, Japanese Un-Examined Patent Publication No. 9-117536, for example, teaches a certain long iron golf club head in which the specific gravity of a hosel is smaller than that of a head body, to thereby enlarge a moment of inertia at the time of swinging (see paragraph 0008 of the publication). Further, a short hosel has been proposed, or a balance weight has been provided in a head body so that the center of gravity of a head may be lowered, which eventually makes it easier to strike balls upwardly.

On the other hand, it is recognized that a longer hosel makes a positive contribution to increasing stability in addressing balls. As a result, there has been a contradictory problem that a hosel need to be formed shorter in order to make it easier to hit balls upwardly, while it need to be formed longer in order to increase stability in addressing the ball.

SUMMARY OF THE INVENTION

To eliminate the above problems, it is, therefore, a main object of the present invention to provide an iron golf club in which it is easy to adjust the position of the center of gravity of a head by preventing the center of gravity from being biased toward a hosel or a heel.

It is another object of the present invention to provide an iron golf club in which balls can be more easily hit upwardly, preventing the center of gravity from becoming too high, while increasing stability in addressing balls by providing a longer hosel.

To attain the above objects, there is provided, in accordance with an embodiment of the invention, an iron golf club, which comprises a head body with a shaft connected thereto, said head body including a face in a front, a heel at a lower portion of a first side of the face and a hosel above the heel, wherein a hollow portion is formed in said hosel or in said heel.

According to the structure, it becomes easier to adjust the center of gravity of the head, preventing the center of gravity from being biased toward the hosel and the heel. To prevent the increase of weight of the hosel 7 and/or the heel eventually leads to preventing the center of gravity of the head 1 from getting too high.

According to another embodiment of the invention, there is provided an iron golf club which comprises a head body with a shaft connected thereto, said head body including a face in a front, a sole in a bottom, a heel at a lower portion of a first side of the face and a hosel above the heel, either or both of said hosel and said heel being formed with a hollow portion, wherein said golf club is formed such that a ratio of a length of an axis defined from an upper end of the shaft through a center of the axis to the sole of the head body relative to a length of the hosel defined from an upper end of the hosel through the axis to the sole is 100 to 6.0 or above.

According to the structure, it is possible to provide an iron golf club in which balls can be more easily hit upwardly, preventing the center of gravity from becoming too high, while increasing stability in addressing balls by providing such a longer hosel.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DESCRIPTION OF PREFERRED EMBODIMENTS

Hereinafter will be described embodiments of the invention with reference to the attached drawings.

Figure 1:
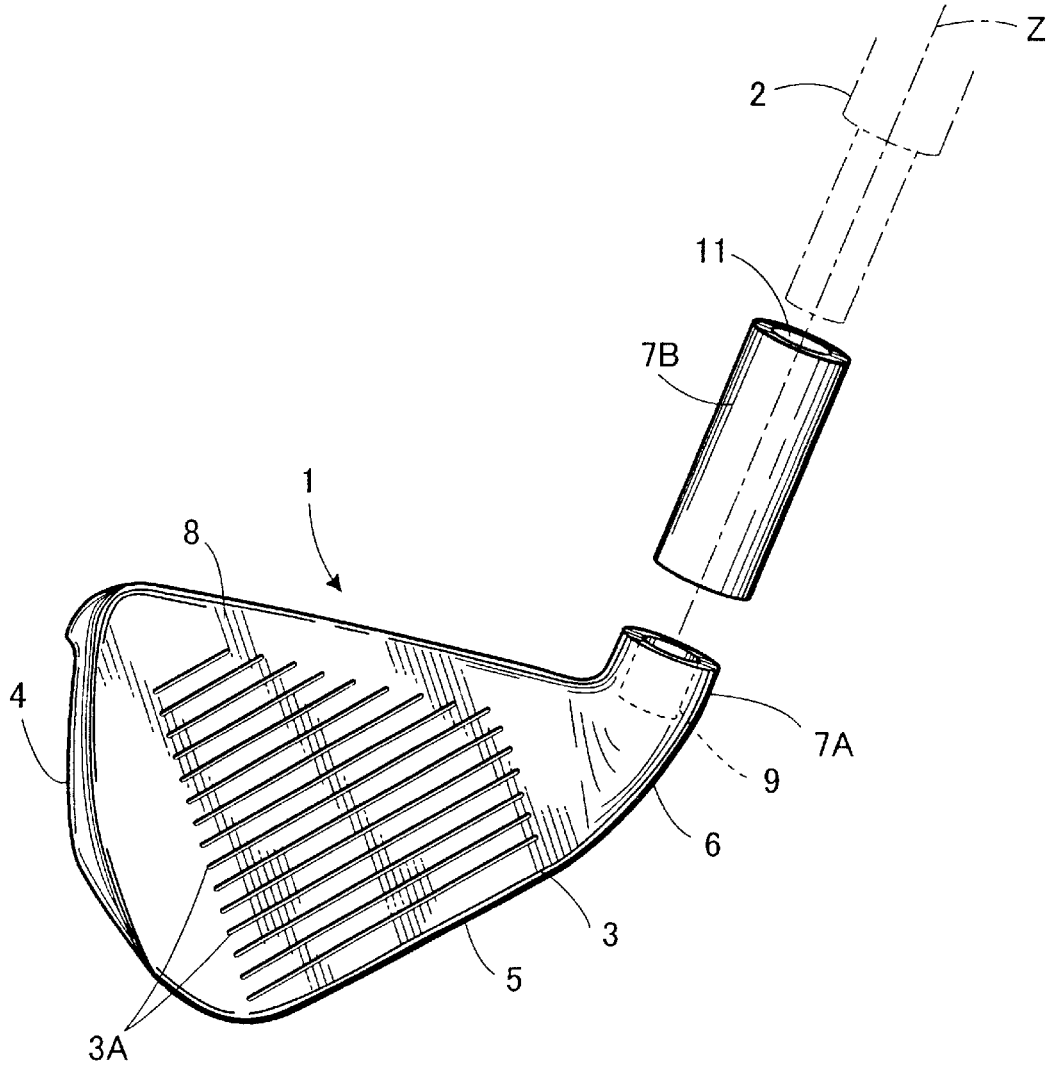
FIG. 1 is an exploded perspective view showing an iron golf club according to a first embodiment of the invention.
Figure 2:
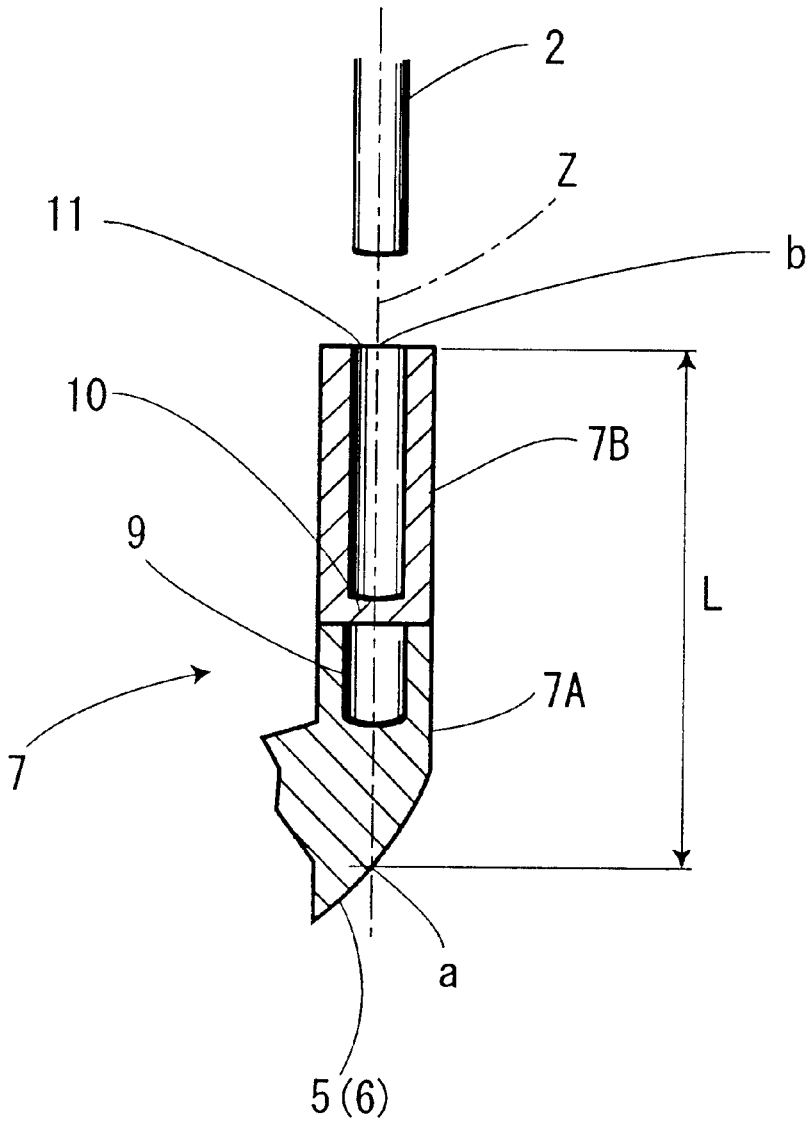
FIG. 2 is a section of a principal part of an iron golf club according to the first embodiment of the invention.
Figure 3:
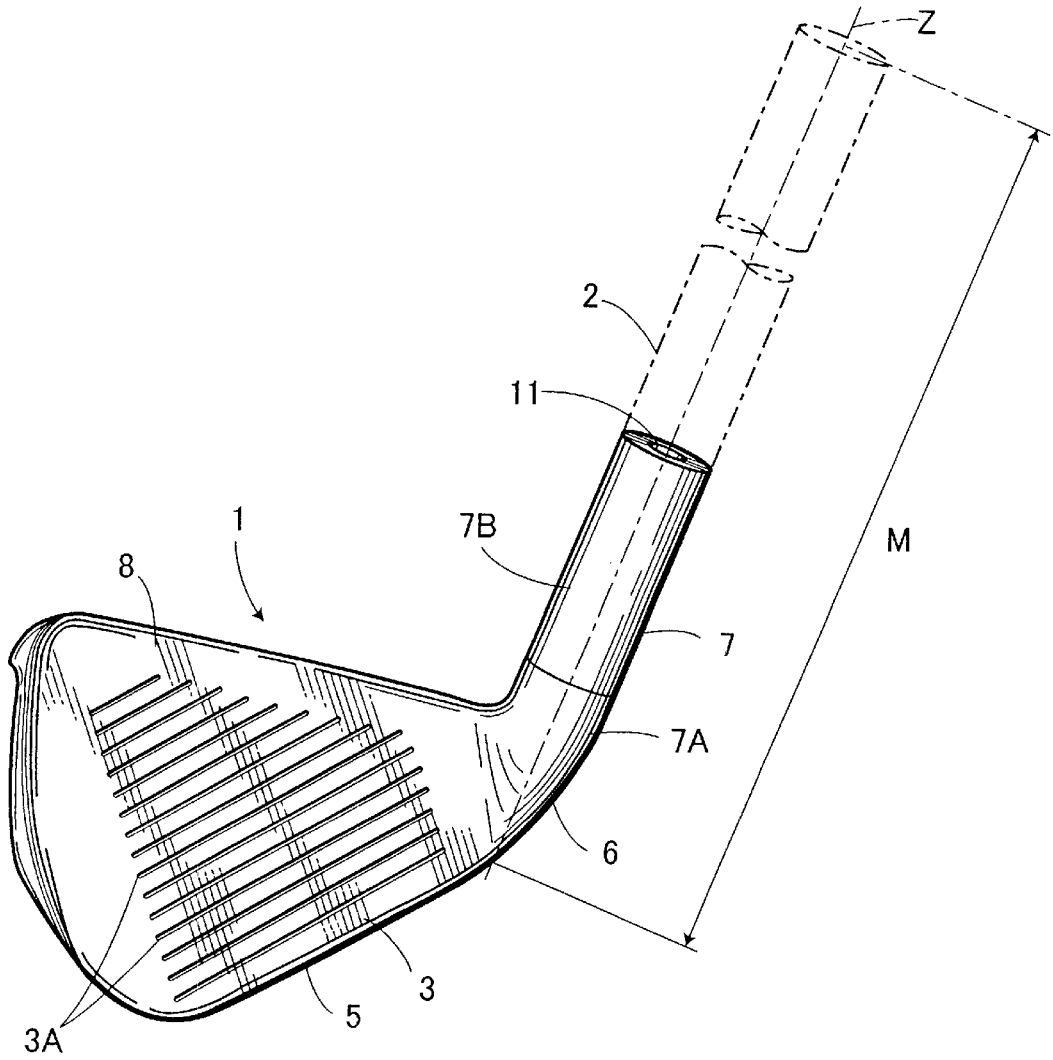
FIG. 3 is a perspective view showing the first embodiment of the invention.

Referring to FIGS. 1 through 3 showing a first embodiment of the invention, an iron golf club of the invention is constructed of a golf club head 1 and a shaft 2 provided above a first end thereof. The head 1 includes a face 3 formed in a front, a rear face portion 4, a sole 5 in a bottom, a heel 6 formed in a lower portion of the said first end, and a hosel 7 formed above the heel 6 for connecting the shaft 2 thereto. Thus, the head 1 is constructed of a head body 8, said head body 8 being formed with the aforesaid face 3, the rear face portion 4, the sole 5, the heel 6 and a hosel base 7A extending from the heel 6 slightly obliquely upwardly; and a hosel body 7B having a lower portion connected with said hosel base 7A, extending obliquely upwardly, coaxially with the hosel base 7A. These head body 8 and the hosel body 7B are made of materials such as steel or stainless steel, by suitable methods such as casting or forging.

The hosel base 7A is formed comparatively short beforehand, formed with a counter sink hole which is defined downwardly from the upper surface thereof, thus forming a hollow portion 9. On the other hand, the hosel body 7B is pipe-shaped, having a bottom, which is manufactured by cutting a round bar material to a predetermined length, and then face grinding it to a preset outside diameter, using a lathe or the like, which is further formed with a shaft insert hole 11 by drilling from an upper surface thereof downwardly so as to form a bottom 10. Then, a lower surface of the bottom 10 of the hosel body 10 is joined to the upper surface of the hosel base 7A. For that purpose, TIG welding, laser welding or friction welding may be used, while the product obtained after the joining process is finished to a final product, by suitable methods such as machining or grinding. In the meantime, reference numeral 3A in the drawing designates lateral grooves formed on the face 3, which are called score lines.

Further, an iron golf club of the invention is formed such that a length M of an axis Z extending from the upper end of the shaft 2 through the center of the shaft 2 to the sole 5 (or heel 6) of the head body 8 is about 40.5 to 39.5 inches (1029–1003 mm) for 1st iron, about 40 to 39 inches (1016–991 mm) for 2nd iron, about 39.5 to 38.5 inches (1003–978 mm) for 3rd iron, about 39 to 38 inches (991–965 mm) for 4th iron, about 38.5 to 37.5 inches (978–953 mm) for 5th iron, about 38 to 37 inches (965–940 mm) for 6th iron, about 37.5 to 36.5 inches (953–927 mm) for 7th iron, about 37 to 36 inches (940–914 mm) for 8th iron, about 36.5 to 35.5 inches (927–902 mm) for 9th iron, about 36 to 35 inches (914–889 mm) for PW, about 36 to 35 inches (914–889 mm) for SW, respectively.

In addition, an iron golf club of the invention is formed to have a length L of the hosel 7 at least equal to 70 mm (i.e., $L \geqq 70$ mm), said length L being defined as the length of the axis Z from an upper end "b" through the respective centers of the shaft 2 and the hosel 7 to a lower end "a". As illustrated in FIG. 2, the lower end "a" is an intersection of the axis Z with the sole 5 (or heel 6), while the upper end "b" an intersection of the axis Z with the upper surface of the hosel 7B.

By forming the hosel 7 to an at least 70 mm length, the ratio of the length M of the axis Z to the length L of the hosel 7 is in the range of 100 to 7.0–6.8, in the case of the 1st iron which is the longest, having the length M of the axis Z ranging from 40.5 to 39.5 inches (1029–1003 mm). On the other hand, in the case of the shortest PW or SW, having the length M of the axis Z ranging from 36 to 35 inches (914–889 mm), such ratio will be in the range of 100 to 7.9–7.7. Accordingly, the ratio of the length M of the axis Z to the length L of the hosel 7 may be at least 100 to 6, preferably at least 100 to 6.8, more preferably in the range of from 100 to 6.8 to 100 to 7.9 (i.e., 100:7.9–6.8).

According to the foregoing embodiment, the head body 8 includes the heel 6 at the lower portion of the first side of the face 3, the hosel 7 above the heel 6, the shaft 2 connected to the hosel 7 and the hollow portion 9 formed in the hosel 7, whereby it is possible to more easily adjust the position of the center of gravity of the head 1 by preventing the center of gravity from being biased toward the hosel 7, preventing the increase of the weight of the hosel 7, which in turn contributes to preventing the center of gravity of the head 1 from being positioned too high.

Further, as the hosel 7 is formed to have the length L at least 70 mm, the feel of stability in addressing balls can be increased. It should be noted that with the length L of the hosel 7 being less than 70 mm, such feel of stability can not be increased.

Furthermore, as an iron golf club according to the foregoing embodiment is formed such that the ratio of the length M of the axis Z defined from the upper end of the shaft 2 to the sole 5 of the head body 8 to the length L of the hosel defined from the upper end of the hosel through the axis Z to the sole 5 is 100 to 6.0 or above, whereby the feel of stability in addressing balls can be increased.

Additionally, as the hollow portion 9 is formed in the hosel 7, it is possible to more easily adjust the position of the center of gravity of the head 1 by preventing the center of gravity from being biased toward the hosel 7, preventing the increase of the weight of the hosel 7, which in turn contributes to preventing the center of gravity of the head 1 from being positioned too high. It should be noted that if the ratio of the length M of the axis Z to the hosel length L is 100 to 6 or below (exclusive of 6), then it is not possible to increase the feel of stability in addressing balls.

In addition to the foregoing, as the hosel 7 is constructed of the hosel base 7A slightly obliquely protruding upwardly from the heel 6 and the pipe-shaped hosel body 7B having the bottom 10, a hollow portion 12 which has an opening on an upper surface, can be covered by the bottom 10, thereby easily forming the said hollow portion 9.

Figure 4:
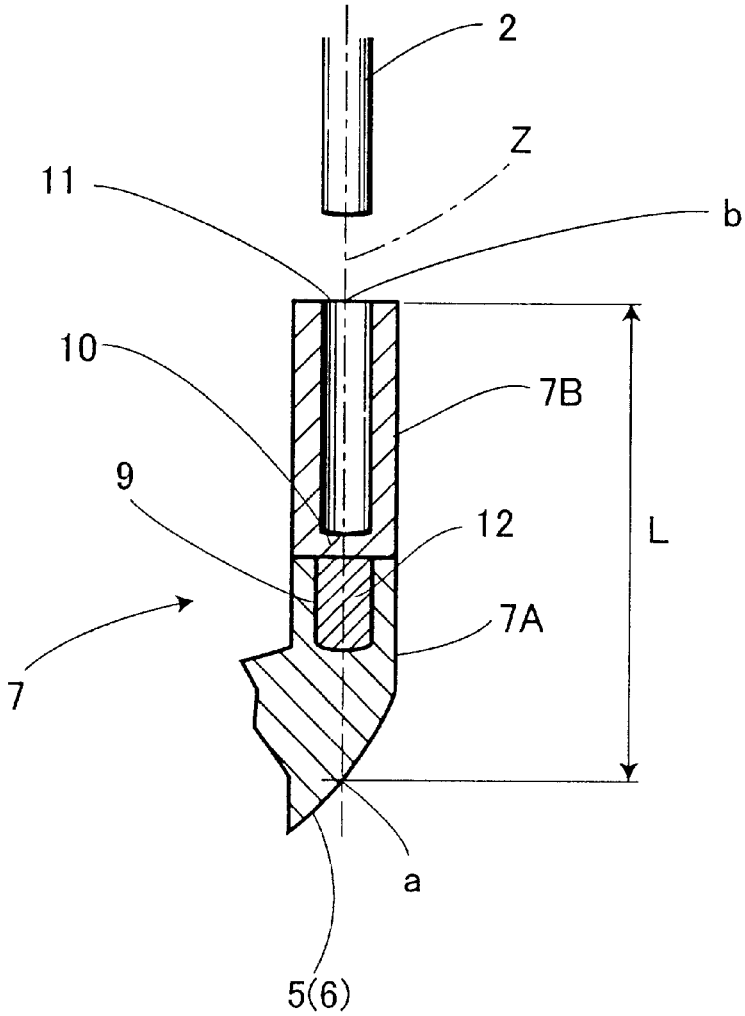
FIG. 4 is a section of a principal part of an iron golf club according to a second embodiment of the invention.

In FIG. 4 showing a second embodiment of the invention, the same portions as those described in the foregoing embodiment will be designated by the same reference numerals, and their repeated detailed description will be omitted.

In the second embodiment, the hollow portion 9 is filled with a filler 12 which has a lighter specific gravity than any of the head body 8 and the hosel body 7B that are made of aluminum, titanium, plastic or resin. After filling the filler 12, the lower surface of the bottom 10 of the hosel body 7B is joined to the upper surface of the hosel base 7A by TIG welding or the like. Accordingly, it becomes possible to adjust the weight distribution of the hosel 7, and that of the head 1 as well by providing the filler member 12 of a lighter specific gravity than the material of the head body 8.

Figure 5:
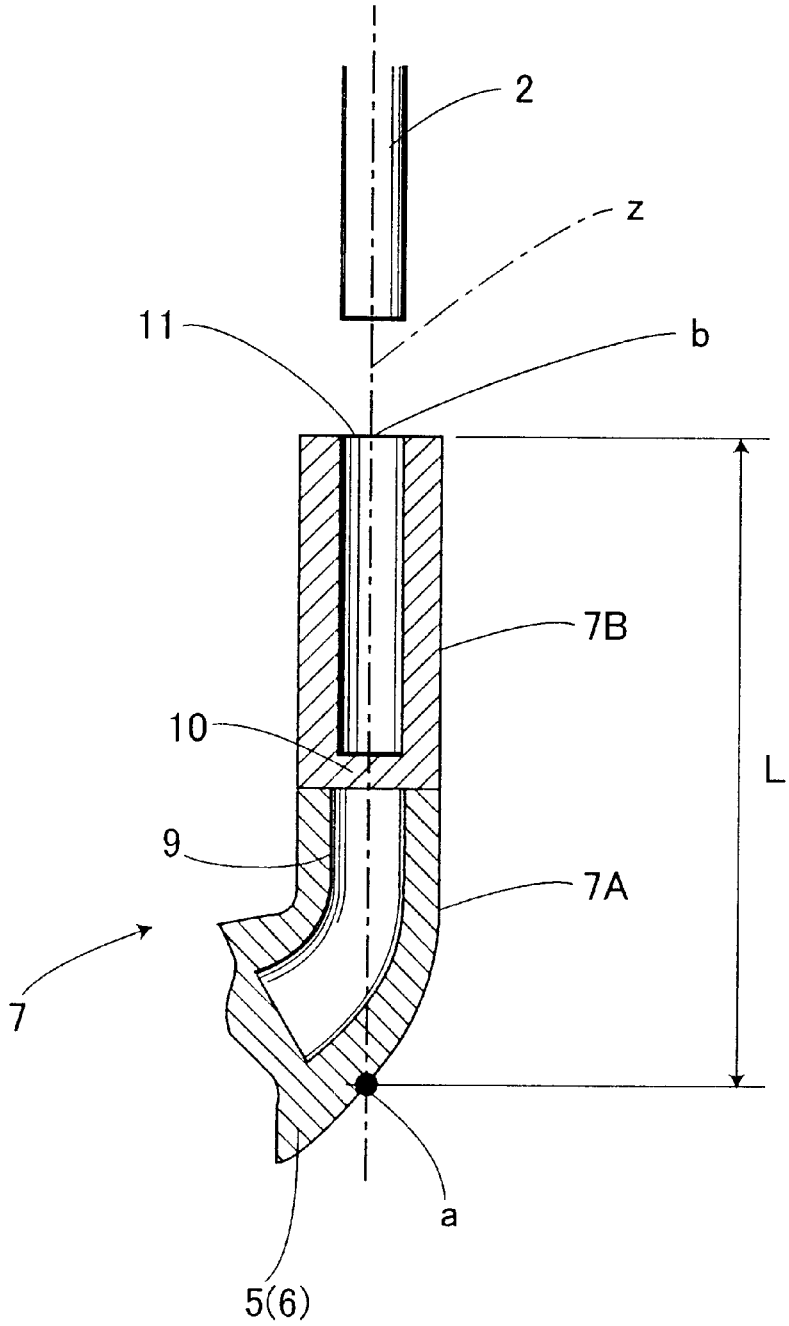
FIG. 5 also is a section of a principal part of an iron golf club according to a third embodiment of the invention.

In FIG. 5 showing a third embodiment of the invention, the same portions as those described in the foregoing embodiment will be designated by the same reference numerals, and their repeated detailed description will be omitted.

In the third embodiment, the hollow portion 9 is provided so as to extend from the hosel base 7A to the heel 6. The hollow portion 9 is formed by manufacturing two separate shells (not shown) by casting, forging or the like, each of the shells forming one half of the hosel base 7A and the heel 6, and then joining these separate shells to the head body 8.

According to the third embodiment, the head body 8 includes the heel 6 at the lower portion of the first side of the face 3, the hosel 7 above the heel 6, the shaft 2 connected to the hosel 7 and the hollow portion 9 formed in the hosel 7, whereby it is possible to more easily adjust the position of the center of gravity of the head 1 by preventing the center of gravity from being biased toward the hosel 7, preventing the increase of the respective weight of the hosel 7 and the heel 6, which in turn contributes to preventing the center of gravity of the head 1 from being positioned too high.

Further, as the hosel 7 is formed to have the length L at least 70 mm, the feel of stability in addressing balls can be increased. It should be noted that with the length L of the hosel 7 being less than 70 mm, such feel of stability can not be increased.

Furthermore, as an iron golf club according to the foregoing embodiment is formed such that the ratio of the length M of the axis Z defined from the upper end of the shaft 2 to the sole 5 of the head body 8 to the length L of the hosel defined from the upper end of the hosel through the axis Z to the sole 5 is 100 to 6.0 or above, the feel of stability in addressing balls can be increased.

Additionally, as the hollow portion 9 is formed in the hosel 7, it is possible to more easily adjust the position of the center of gravity of the head 1 by preventing the center of gravity from being biased toward the hosel 7, preventing the increase of the weight of the hosel 7, which in turn contributes to preventing the center of gravity of the head 1 from being positioned too high. It should be noted that if the ratio of the length M of the axis Z to the hosel length L is 100 to 6 or below (exclusive of 6), then it is not possible to increase the feel of stability in addressing balls.

Incidentally the present invention should not be limited to the foregoing embodiments, but may be modified within the scope of the invention.

For example, whilst the hosel 9 is closed by the bottom 10 of the hosel body 7B in the foregoing embodiments, the hosel body 7B may be pipe-shaped, having no bottom 10, so that the hollow portion 9 may communicate with the insertion hole 11.

What is claimed:

1. An iron golf club, comprising:

a head with a shaft connected thereto, said heed including a face in a front, a heel at a lower portion of a first side of the face and a hosel above the heel;

wherein said head is constructed of a head body, which is formed with a hosel base extending from said heel obliquely upwardly, and a hosel body which is connected with said hosel base and forms said hosel;

wherein said hosel body is pipe-shaped and has a bottom which defines an inner bottom surface and an outer bottom surface;

wherein said hosel base is formed with a hollow portion defined downwardly from an upper surface thereof; and wherein a lower most part of said outer bottom surface of said hosel body is joined to an upper most part of said upper surface of said hosel base.

2. An iron golf club according to claim 1, wherein said hosel is formed to have a length of 70 mm or above.

3. An iron golf club according to claim 1, wherein said hollow portion is filled with a member which has a lighter specific gravity than a material of said head body.

4. An iron golf club, comprising:

a head with a shaft connected thereto, said head including a face in a front, a sole in a bottom, a heel at a lower portion of a first side of the face and a hosel above the heel;

wherein said golf club is formed such that a ratio of a length of an axis defined from an upper end of the shaft through a center of the axis to the sole of the head body relative to a length of the hosel defined from an upper end of the hosel through the axis to the sole is 100 to 6.0 or above;

wherein said head is constructed of a head body which is formed with a hosel base extending from said heel obliquely upwardly, and a hosel body which is connected with said hosel base and forms said hosel;

wherein said hosel body is pipe-shaped and has a bottom which defines an inner bottom surface and an outer bottom surface;

wherein said hosel base is formed with a hollow portion defined downwardly from an upper surface thereof; and wherein a lower most part of said outer bottom surface of said hosel body is joined to an upper most part of said upper surface of said hosel base.

5. An iron golf club according to claim 2, wherein said hollow portion is filled with a member which has a lighter specific gravity than a material of said head body.

6. An iron golf club according to claim 4, wherein said hosel is formed to have a length of 70 mm or above.

7. An iron golf club according to claim 4, wherein said hollow portion is filled with a member which has a lighter specific gravity than a material of said head body.

8. An iron golf club according to claim 6, wherein said hollow portion is filled with a member which has a lighter specific gravity than a material of said head body.

* * * * *

UNITED STATES PATENT AND TRADEMARK OFFICE

CERTIFICATE OF CORRECTION

PATENT NO. : 6,561,921 B2
DATED : May 13, 2003
INVENTOR(S) : Takeda, Hitoshi

It is certified that error appears in the above-identified patent and that said Letters Patent is hereby corrected as shown below:

Column 1,
Line 40, replace “heed” with -- head --.

Signed and Sealed this

Twenty-ninth Day of June, 2004

JON W. DUDAS
*Acting Director of the United States Patent and Trademark Office*